United States Patent [19]

Kato

[11] Patent Number: 4,768,250

[45] Date of Patent: Sep. 6, 1988

[54] FLUIDIZED BEAD BED

[75] Inventor: Shigeya Kato, Kanagawa, Japan

[73] Assignee: Fuji Electric Co., Ltd., Kanagawa, Japan

[21] Appl. No.: 71,570

[22] Filed: Jul. 10, 1987

Related U.S. Application Data

[63] Continuation of Ser. No. 760,550, Jul. 30, 1985, abandoned.

[51] Int. Cl.[4] ..... A47C 27/08

[52] U.S. Cl. ..... 5/453; 5/461; 5/469; 5/473; 5/502

[58] Field of Search ..... 52/423, 449–458, 52/461, 462, 468, 469, 473, 495; 128/33, 38; 5/496, 499–502

[56] References Cited

U.S. PATENT DOCUMENTS

| | | | |
|---|---|---|---|
| 3,608,961 | 9/1971 | Van Heck | 5/453 |
| 3,822,425 | 7/1974 | Scales | 5/456 |
| 3,866,606 | 2/1975 | Hargest | 128/71 |
| 3,949,438 | 4/1976 | Scales | 5/453 |
| 4,472,847 | 9/1984 | Gammons et al. | 5/453 |
| 4,481,686 | 11/1984 | Lacoste | 5/453 |
| 4,498,462 | 2/1985 | Henley | 128/24.1 |
| 4,599,755 | 7/1986 | Tominaga | 5/453 |

FOREIGN PATENT DOCUMENTS

| | | | |
|---|---|---|---|
| 550650 | 5/1932 | Fed. Rep. of Germany | 5/450 |
| 932779 | 7/1963 | United Kingdom | 5/451 |
| 1594111 | 7/1981 | United Kingdom | 5/451 |

*Primary Examiner*—John E. Murtagh
*Assistant Examiner*—Andrew Joseph Rudy
*Attorney, Agent, or Firm*—Finnegan, Henderson, Farabow, Garrett and Dunner

[57] ABSTRACT

A fluidized bead bed includes a mattress having an outer, liquid-impermeable layer to prevent body fluids from passing into a bed tub holding fluidized beads and contaminating the beads. The bed tub includes apertures near its upper edges to exhaust pressurized air from the bed tub.

5 Claims, 2 Drawing Sheets

FLUIDIZED BEAD BED

This application is a continuation, of application Ser. No. 760,550, filed July 30, 1985, now abandoned.

FIELD OF THE INVENTION

This invention relates to an improvement in a fluidized bead bed wherein a filter sheet is adapted to cover the upper surface of a box-like bed tub filled with finely divided beads, and compressed air is supplied to the interior of the bed tub from below to fluidize the beads so that the patient is supported in a floating state.

BACKGROUND OF THE INVENTION

A conventional bead bed 1 is shown in FIG. 1 wherein a patient 2 is shown lying on the bed 1. The bed 1 generally comprises in combination a box-like bed tub 3 having a sufficient size to accommodate the patient 2 and ceramic beads 4 substantially filling the bed tub 3. The beads 4 are made, for example, of resin-coated finely divided glass having a specific gravity of approximately 2 to 3 and a particle size of 50 to 150 microns.

An air permeable filter sheet 5 is fixedly attached to the peripheral edges of the bed tub 3 to cover the upper surface thereof. The mesh of the filter sheet 5 is smaller than the particle size of the beads 4. A plenum chamber 6 is provided at the lower part of the bed tub 3 with a porous air diffusion plate 7 being located between the plenum chamber 6 and the bed tub 3. An air blower 9 is provided in a machine housing 8. The housing 8 also serves as a base for the bed. Sheet press members 10 retain the filter sheet 5 at the peripheral edges of the bed tub 3.

In such arrangement when the air blower 9 is inoperative, the beads are no longer fluidized and become stationary. The patient 2 lying on the bed at that time feels like he is resting on sand. When the air blower is operated to supply compressed air through the plenum chamber 6 and the air diffusion plate 7 to the interior of the bed tub 3, the beads 4 contained in the bed tub 3 by means of the filter sheet 5 become fluidized under the influence of the compressed air. The specific gravity of the beads 4 is lowered to approximately 1.1 to 1.2 and the patient is supported in a substantially floating state. Under such a condition, the contact pressure exerted on the patient 2 is significantly lessened and the patient feels as if he is floating in the air. After passing through the bed tub 3, the air enters the ambient environment through the filter sheet 5.

The above-described bed arrangement has the advantages that when used for medical purposes, the effectiveness of treatment is improved by restraining application of constant pressure to the affected part of the patient suffering from a burn, for example. Bedsores are also prevented on a patient under medical care for a prolonged period of time by lessening the contact pressure between the bed and the patient.

An air permeable sheet is generally used as the filter sheet 5 to cover the upper surface of the bed tub 3. Because the filter sheet 5 is air permeable, the patient's body fluids or the like are likely to permeate the filter sheet 5 and become deposited on the beads 4 in the bed tub 3. This contaminates the beads 4 and causes them to stick together and thereby deteriorating the flowability of the beads. Moreover, propagation of bacilli takes place and results in the emanation of an unpleasant odor. In the past, it has been necessary to periodically disinfect, rinse, or replace the beads 4 for hygienic purposes and such measures are inconvenient and costly.

In addition, the air supplied to the interior of the bed tub is directed upwards through the filter sheet 5 and is discharged around the patient 2. This may cause the patient discomfort. Since the air flows directly around the patient, it has been necessary to control the temperature of the compressed air supplied to the interior of the bed tub from the air blower 9 so that the air ultimately discharged around the patient is a suitable temperature.

OBJECT AND SUMMARY OF THE INVENTION

An object of the present invention is to eliminate the discharge of air on and around a patient lying on a fluidized bead bed.

Another object of the present invention is to eliminate the necessity of precisely controlling the temperature of pressurized air used to fluidize beads in a fluidized bead bed.

A further object of the present invention is to prevent the contamination of beads in a fluidized bead bed with the body fluids of a patient lying on the bed.

Still another object of the present invention is to decrease the costs and inconvenience of maintaining and using fluidized bead beds.

These and other objects are attained by a fluidized bead bed comprising a bed tub having an upper opening and air exhaust apertures formed proximate the opening, a plurality of beads in the tub, means for supplying compressed air to the tub to fluidize the beads therein, and a flexible, liquid impermeable sheet covering the opening and adapted to prevent the beads from passing through the opening when the supplying means supplies compressed air to fluidize the beads.

BRIEF DESCRIPTION OF THE DRAWINGS

The manner in which the above objects and other objects, features, and advantages are attained as well as the construction and operation of the invention will be readily understood from the following detailed description when considered in view of the drawings, wherein.

DETAILED DESCRIPTION

Figure 1:
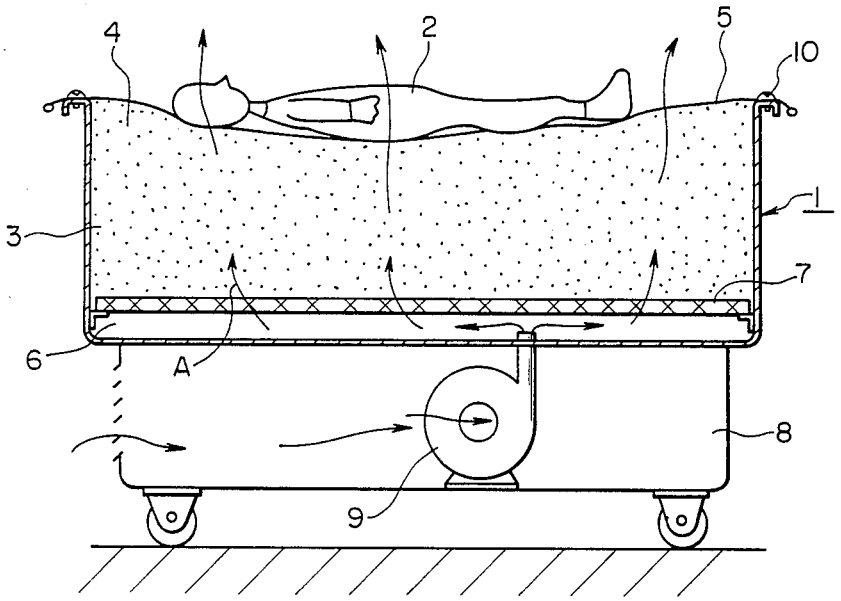
FIG. 1 is a sectional view of a conventional fluidized bead bed.
Figure 2:
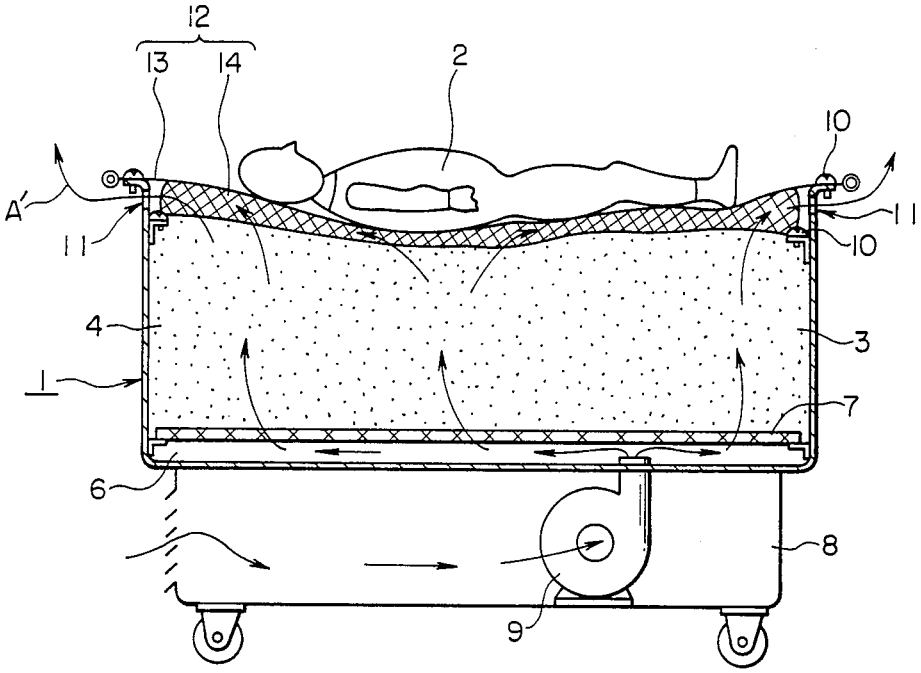
FIG. 2 is a sectional view of a fluidized bead bed according to a preferred embodiment of the present invention.
Figure 3:
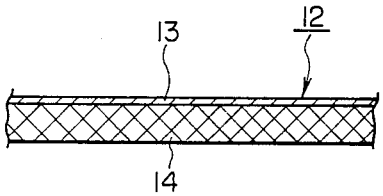
FIG. 3 and 4 are enlarged partial cross sections illustrating embodiments of the present invention.
Figure 4:
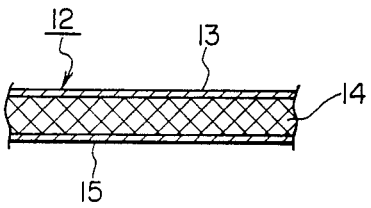

FIG. 2 through FIG. 4 show preferred embodiments of the present invention. In FIG. 2, the bed tub 3 has side walls which define the peripheral surface and peripheral edge ofthe bed tub. The peripheral edge forms the upper opening of the bed tub 3. The side walls, at the upper peripheral surface, have exhaust apertures 11 communicating with the environment outside the bed tub. The patient is supported on the bed tube by sheet 12. Sheet 12 is constructed as a flexible composite and includes a flexible air and liquid impermeable sheet 13 and an air permeable mattress 14. Sheet 13 is attached to the peripheral edge of the bed tube 3 by sheet press members 10 which hold and anchor sheet 12, thereby covering the upper surface of the bed tub 3. the mattress 14, which must be of sufficient thickness, is attached to the underside of flexible sheet 13. Sheet 13 is made of an air liquid impermeable material such as vinyl or rubber. The air permeable mattress 14 is made of felt or open cell foam, the interstices of which are selected so that the beads 4 do not pass freely therethrough.

As shown in FIG. 4, a filter sheet 15 of fine mesh through which the beads are unable to pass may be coated on the underside of the air permeable mattress 14. In this manner, the interstices of the air permeable mattress 14 may be freely selected.

With such arrangement, after the air supplied to the interior of the bed tub 3 flows upwardly therein so as to fluidize the beads 4, it is directed to the outside of the bed through the apertures 11 formed at the upper peripheral surface of the bed tub 3. Thus, the exhausted air is not exhausted directly around the patient 2, as was the case with prior art bead beds. In addition, the air permeable mattress 14 acts as a thermal insulation material and a cushioning member, to enhance the comfort of the bed. Still further, the air permeable mattress 14 per se provides an air flow passage in the upper part of the bed tub 3 so that fluidization of the beads is not deteriorated. The liquid impermeable sheet 13 constitutes the upper part of the sheet 12. Thus, a patient's body fluids and the like do not permeate the sheet 12, and contaminate the beads in the bed tub 3.

As described hereinabove, according to the present invention, a fluidized bead bed includes a bed tub filled with beads and having an upper surface covered with a filter sheet. Compressed air is supplied to the interior of the bed tub from below to fluidize the beads. A flexible and liquid impermeable sheet is used at least for the upper side of the filter sheet and the bed tub has formed at its upper peripheral surface several exhaust apertures. Thus, no body fluids of the patient lying on the bed permeate and contaminate the beads contained in the bed tub. In contrast to the prior art beds, hygienic qualities of the bed are substantially improved. Futhermore, the air supplied to the interior of the bed tub is directed to the outside of the bed in a transverse direction so that it does not contact and annoy the patient.

It should be understood that the present invention is not limited to the particular embodiments described, but is susceptible to modifications, alterations, and equivalent arrangements within the scope of the appended claims.

What is claimed is:

1. A fluidized bead bed comprising:

a bed tub having side walls and a peripheral edge forming an upper opening and having air exhaust apertures formed in said side walls proximate said opening and below said peripheral edge;

a plurality of beads in said tub;

a means for supplying compressed air to said tub to fluidize said beads therein; and a flexible, liquid imperamable support member covering said opening, said support member including a liquid impermable sheet covering said opening and an air permeable mattress member attached at the undersurface of said sheet, support member being anchored to said peripheral edge and being adapted to prevent said beads from passing through said opening when said supplying means supplies compressed air to fluidize said beads, said compressed air flowing through said beads and said mattress and being exhausted through said air exhaust apertures.

2. A fluidized bead bed according to claim 1, further including an air permeable filter sheet substantially impenetrable by said beads attached to the lower surface of said mattress.

3. A fluidized bead bed according to claim 1, wherein said air exhaust aperatures are open to an ambient environment proximate the outside of the bed.

4. A fluidized bead bed according to claim 1, wherein said mattress includes an air permeable filter.

5. A fluidized bead bed according to claim 1, wherein said liquid impermeable sheet is substantially impermeable to air.

* * * * *